United States Patent [19]

Tsui et al.

[11] 4,341,034

[45] Jul. 27, 1982

[54] TOY WASHING MACHINE

[75] Inventors: Kwok W. Tsui; Sing C. J. Yuen, both of Hong Kong, Hong Kong

[73] Assignee: Arco Industries Ltd., Hong Kong, Hong Kong

[21] Appl. No.: 252,310

[22] Filed: Apr. 9, 1981

[51] Int. Cl.[3] ..... A63H 3/52

[52] U.S. Cl. ..... 46/14

[58] Field of Search ..... 46/14, 39, 47

[56] References Cited

U.S. PATENT DOCUMENTS

| | | | |
|---|---|---|---|
| 1,658,611 | 2/1928 | Pahl . | |
| 1,848,027 | 3/1932 | Riemenschneider . | |
| 2,615,280 | 10/1952 | Thelin . | |
| 2,831,293 | 4/1958 | Götz | 46/14 |
| 3,187,459 | 6/1965 | Glass et al. . | |
| 3,774,338 | 11/1973 | Waak | 46/14 |

*Primary Examiner*—Robert Peshock
*Assistant Examiner*—Mickey Yu
*Attorney, Agent, or Firm*—C. Hercus Just

[57] ABSTRACT

A toy washing machine having a cabinet with a top opening in alignment with a tub in the cabinet and a rotatable agitator movable about a vertical axis by mechanism driven by a manually operated rack and gear train unit including one throwout gear operable when the rack is slidably moved in one direction to function with the train to drive the agitator in rotatable manner but be thrown out of operation in the gear train when the rack is moved in return direction. A flywheel also is driven by the gear train to facilitate unidirectional rotation of a rotatable member operated by the gear train.

8 Claims, 5 Drawing Figures

TOY WASHING MACHINE

BACKGROUND OF THE INVENTION

Toy washing machines have been developed heretofore as playthings for children. Over the years, the styles of then existing washing machines have been used as motifs in designing such toys. Typical of prior toy washing machines are the mechanisms comprising the subject matter of the following U.S. Patents:

| | | |
|---|---|---|
| 1,658,611 | Pahl | Feb. 7, 1928 |
| 1,848,027 | Riemenschneider | March 1, 1932 |
| 2,615,280 | Thelin | Oct. 28, 1952 |
| 3,187,459 | Glass et al | June 8, 1965 |

In the foregoing patents, it will be seen that in the patent to Pahl, a lever and ratchet arrangement is employed simply to rotate a flywheel. The Riemenschneider patent has a vertically movable agitator. The Thelin and Glass et al patents simulate a very popular type of full-scale washing machine, known as the Bendix-type, and including a rotatable drum operable about a horizontal axis.

There are other possibilities for designing toy washing machines to produce a life-like machine in miniature which is different from any that have been developed heretofore, and the present invention comprises an advance in the toy art by including details in the machine that are set forth below:

SUMMARY OF THE INVENTION

It is among the principal objects of the present invention to produce a toy washing machine in which a tub, having a vertical axis, is disposed in a suitable cabinet and a ribbed rotating type agitator is supported in the tub upon a vertical axis, the rotation being effected by a movable finger piece having a knob engageable on the exterior of the front panel of the cabinet and preferably adapted to be reciprocated in a manner to produce continuous rotation of the agitator in the tub.

It is another object of the invention to include driving mechanism of a rack and pinion type associated with a gear train and including means to permit return of the rack in non-driving direction following each reciprocation of the rack in driving direction, whereby there would be no interference upon the return reciprocation of the rack.

It is a further object of the invention to include in the drive mechanism a flywheel to facilitate continuous movement in driving direction of the means by which oscillation is effected.

Still another object of the invention is to effect rotation of the vertical shaft for the agitator by means of a spur gear on the lower end of the shaft engageable by a larger diameter throw-out gear, which is driven in one direction by said rack and pinion mechanism and return of the rack in non-driving direction being permitted by movement of the throw-out gear away from said spur gear and thus not interfere with the unidirectional rotation of said shaft and agitator.

Still another object of the invention is to provide the housing with a hinged cover in the top extending over the tub and agitator and otherwise provide imitation simulated control members and dials similar to those employed in full-scale washing machines.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT

Figure 1:
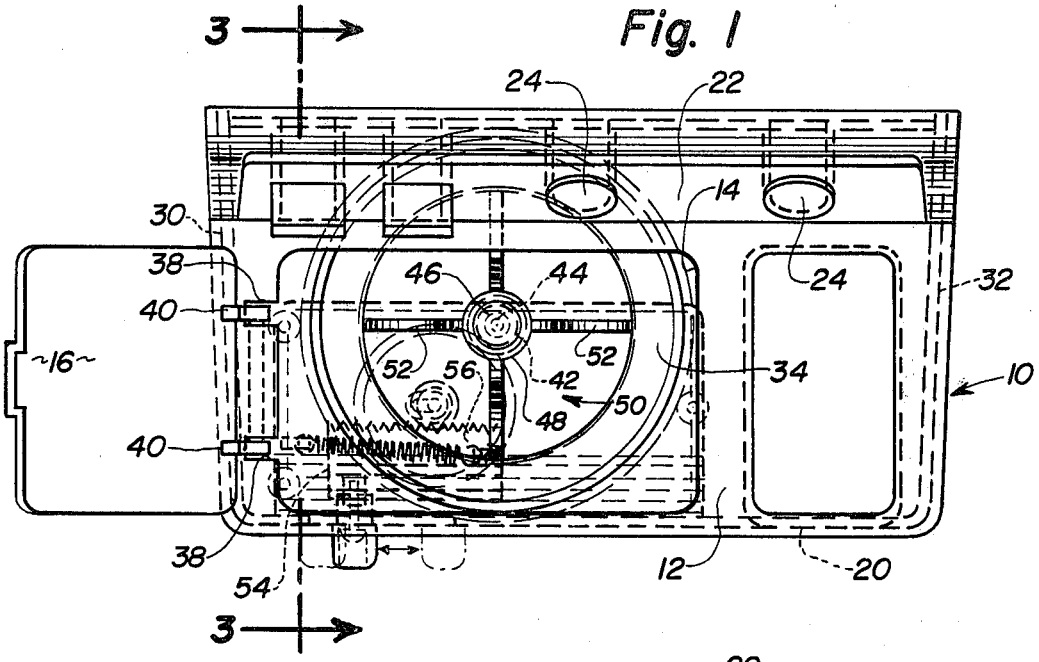
FIG. 1 is a top plan view of a toy washing machine embodying the principles of the present invention and illustrated with the hinged cover in open position.
Figure 2:
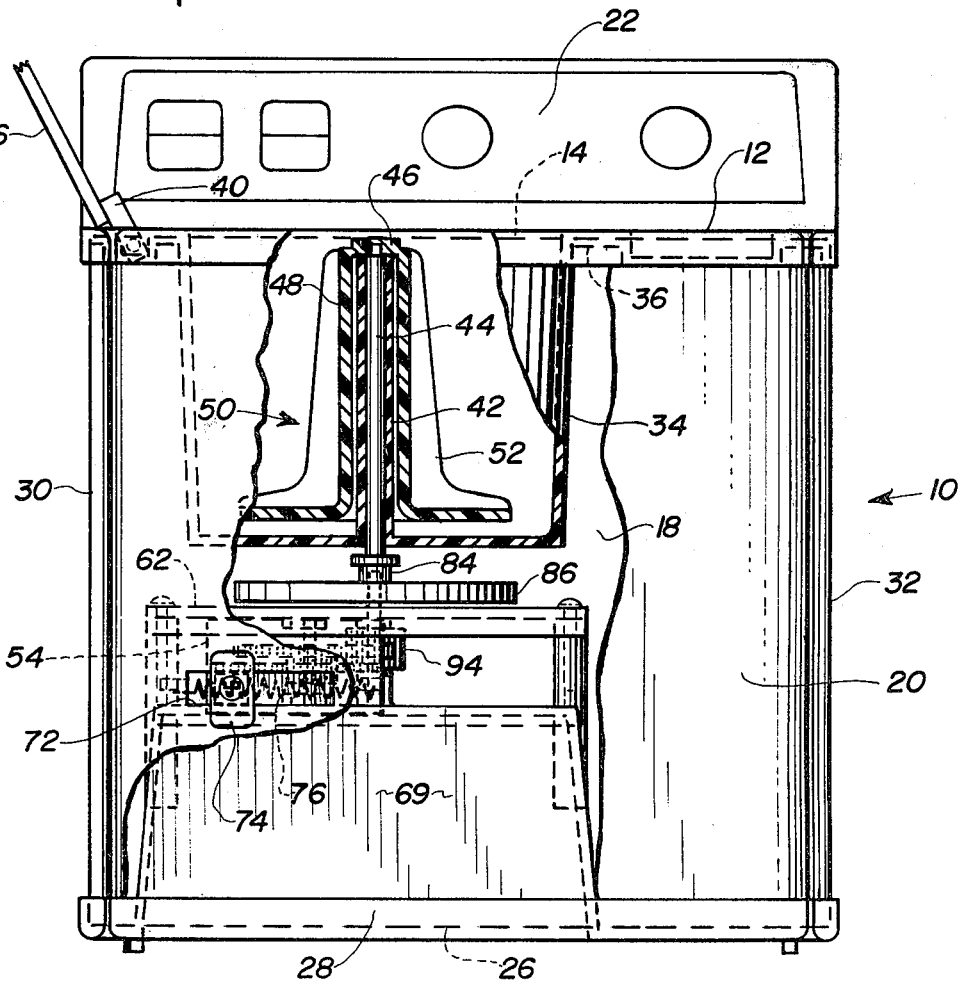
FIG. 2 is a front elevation of the washing machine shown in FIG. 1, with the front panel of the cabinet partly broken away to expose details of the interior of the machine, the open cover also being illustrated only fragmentarily.

Referring to FIGS. 1 and 2, it will be seen that the toy washing machine comprising the present invention includes a boxlike cabinet 10 formed with a top panel 12, having a rectangular opening 14 provided therein and extending from one edge toward the other, said opening being provided with hinged cover 16 commensurate in area with the opening 14. The cabinet also includes a rear vertical wall 18 and a parallel vertical front panel 20, which is shorter than the rear wall 18, the latter extending above the upper surface of the top panel 12 for purposes of providing a rearward and upwardly extending panel 22 upon which imitation dials 24 and the like are imprinted or formed. The cabinet 10 extends upward from a bottom panel 26 and preferably has a short upstanding wall 28 integral with the circumferential edges of the bottom panel 26 for purposes of receiving the lower edges of the rear wall 18, front panel 20, and side panels 30 and 32. For purposes of minimizing the cost of manufacture without depreciating quality and durability, it is preferred that, as far as possible, all of the components of the toy washing machine comprising the invention are made from rigid plastic material which, in view of the formation of adjacent edges of the various panels, permits ready assembly of all of the components of the box-like cabinet, as well as interior elements thereof. However, such indication of preferred material is intended to be exemplary, rather than restrictive, since, for example, it is readily possible to form especially the elements of the box-like cabinet from sheet metal or other appropriate material.

Figure 3:
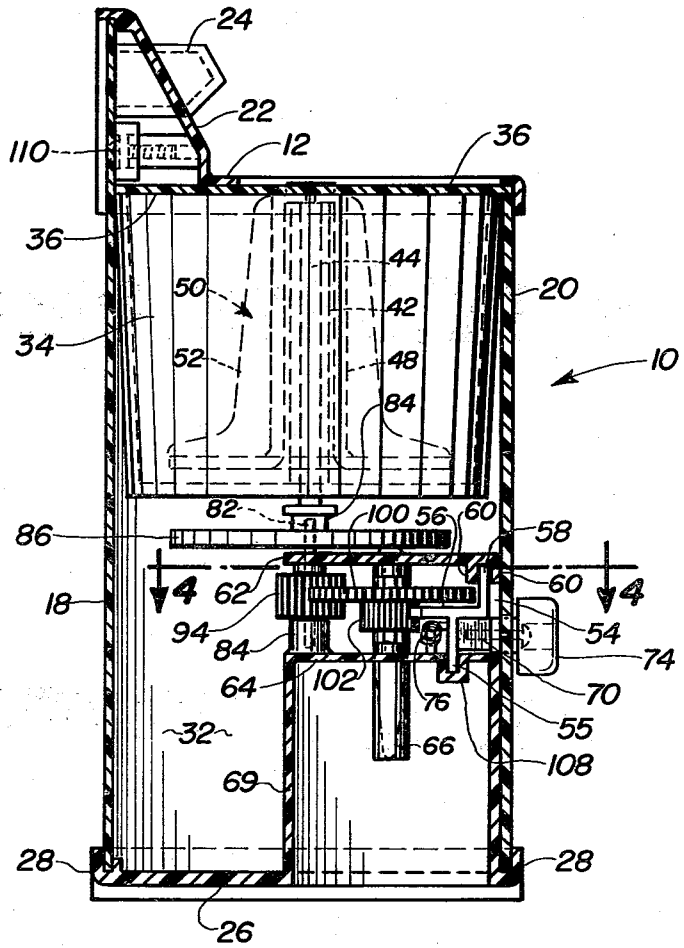
FIG. 3 is a vertical sectional view of the toy washing machine shown in FIG. 1, as seen on the line 3—3 thereof.

Mounted within the upper portion of the box-like cabinet 10 is a cup-shaped tub 34, which is circular in cross-section and the upper rim thereof is integral with a horizontal sub-plate 36, which primarily extends from opposite sides of the tub 34 respectively toward the upper edges of the side panels 30 and 32 and immediately underlies the top panel 12, as clearly shown in FIG. 3, the opposite edges of the sub-plate 36 engaging and resting upon the upper edges of the side panels 30 and 32 for support thereby. The edge of the sub-plate 36 nearest the side panel 30 also is provided with slots 38 through which hinge ears 40 extend, said ears being integral with one edge of the cover 16, as best shown in FIGS. 1 and 2. Extending upwardly from the bottom of the tub 34 is a central sleeve 42 molded integrally with the tub 34, the upper end being open to permit the upper end of agitator drive shaft 44 to extend therethrough for reception within a socket 46 formed in the upper end of a thimble 48 of oscillatory agitator 50, having a plurality of agitating ribs 52 thereon. The socket 46 and upper end of drive shaft 44 are integrally connected for rotatable movement of the agitator 50 by means of drive shaft 44 as driven by mechanism described hereinafter. In general, the agitator 50 is similar in shape to that in many popular types of full-scale washing machines.

Figure 4:
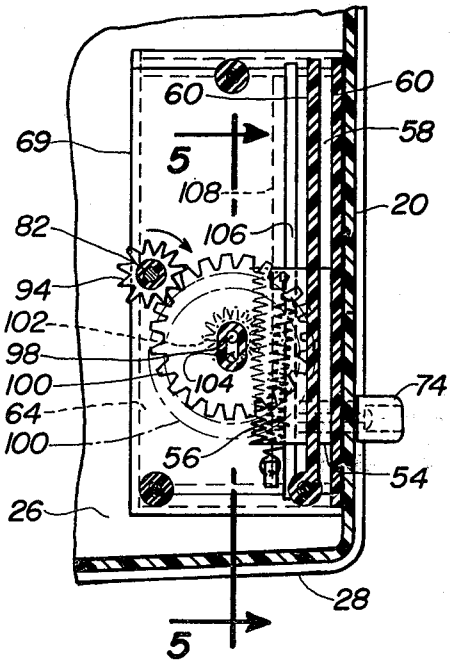
FIG. 4 is a fragmentary horizontal sectional view of the machine shown in FIG. 3, as seen on the line 4—4 thereof.
Figure 5:
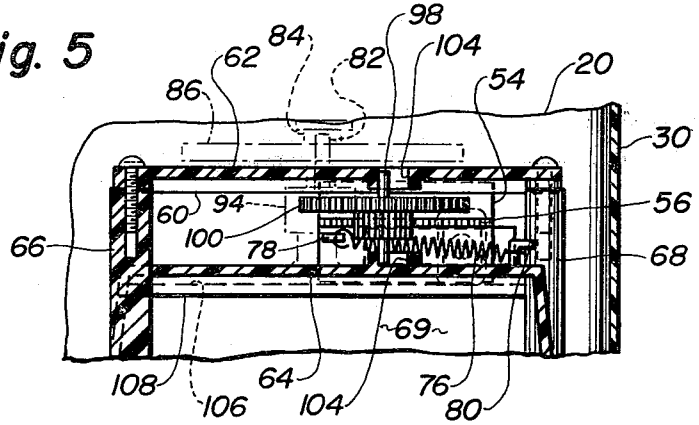
FIG. 5 is another fragmentary vertical sectional view of the machine shown in FIG. 4, as seen on the line 5—5 thereof, and illustrating details of the drive mechanism.

The agigator drive shaft 44 is manually driven by means of a slide 54 which, in end view, as seen in FIG. 3, is L-shaped and has a vertical depending rib 55 and the lateral horizontal flange 56 of said slide terminates in a straight toothed rack, best illustrated in plan view in FIG. 4 and in edge view in FIG. 5. The upper edge of the vertical flange of slide 54 is straight and is slidably guided within a guide slot 58, best shown in FIG. 3, formed by a pair of parallel ribs 60 integrally molded with the upper surface of top horizontal mounting plate 62 which is also parallel to and vertically spaced above the lower horizontal mounting plate 64. Opposite ends of the upper mounting plate 62 respectively are supported by post-like supporting members 66 and 68, which, as best seen in FIG. 5, are formed on the opposite ends of a box-like configuration 69 molded intergrally with and extending upwardly from bottom panel 26, as clearly shown in FIGS. 2 and 3, the horizontal top of configuration 69 comprising the lower horizontal mounting plate 64.

Projecting laterally from one face of depending rib 55 of the slide 54 which is nearest front panel 20 is a projection 70, the outermost end of which extends through a slot 72 horizontally formed in the front panel 20, see FIG. 2, and the outer end of said projection has a finger-engageable button 74 thereon, which comprises the sole manually-engageable element of the entire drive mechanism and the same moves in opposite reciprocatory driving and return directions. It is manually moved in driving direction and a tension spring 76, best shown in FIG. 5, returns the button 74 and the slide to which it is connected to starting position. The spring 76 extends between lugs 78 and 80 respectively formed on slide 54 and lower mounting plate 64, as clearly shown in FIG. 5.

The drive mechanism for rotating drive shaft 44 comprises power transfer means between the manually-operable slide 54 and said drive shaft, and includes a vertical main drive shaft 82, which extends through a bearing opening in the top mounting plate 62, and the lower end is rotatable within a fixed bearing socket 84 on the upper surface of lower mounting plate 64, as clearly shown in FIG. 3. The upper end of drive shaft 82 extends into a socket 84 on the lower end of agitator drive shaft 44, said socket also being fixed to a flywheel 86 directly above top mounting plate 62, as shown in FIGS. 2 and 3.

Main drive shaft 82 is driven unidirectionally by means of a spur gear 94 thereon, as shown by the arrow in FIG. 4, and such inidirectional rotation of shaft 82 and agitator 50 is enchanced and insured by flywheel 86, comprising a disc of substantial weight in relation to other members of the driving mechanism.

Initial rotation of the main drive shaft 82 in driving direction for purposes of rotating agitator drive shaft 44 is accomplished by a simple gear train actuated by the rack teeth on slide 54 and including a shaft 98 upon which a throw-out gear 100 is fixed in coaxial relation with a fixed drive pinion 102 on shaft 98, said drive pinion 102 directly meshing with the rack teeth of the slide 54. Opposite ends of the shaft 98 respectively are mounted in relatively short slots 104 respectively formed in short bosses formed on the facing surfaces of top and lower mounting plates 62 and 64, as clearly shown in FIG. 5. The slots 104 need only be slightly greater in length than the length of the gear teeth on spur gear 94 and throw-out gear 100. Also, to provide adequate guiding of slide 54, the depending rib 55 of slide 54 is slidable in a groove 106 in depending elongated rib 108, as shown in FIGS. 3 and 5.

The slots and the movement of the shaft 98 therein constitutes power release means in view of the fact that spring 76 normally maintains the slide 54 with its rack teeth thereon in initial starting position in which the engagement of the rack with the drive pinion 102 maintains the shaft 98 and the gear 100 and pinion 102 in retracted position in which the teeth of gear 100 are out of engagement with the teeth of spur gear 94, as shown in phantom in FIG. 4. When the button 74 is moved toward the right, as viewed in FIG. 1, the initial movement of the rack teeth of slide 54 is to initiate rotation of pinion gear 102 and its shaft 98 toward the main drive shaft 82 and effect meshing of the teeth of throw-out gear 100 with the spur gear 94 of main drive shaft 82. After the shaft 98 has reached the position illustrated in cross-section in FIG. 4, continued movement of the slide 54 effects continuous rotation of all of the gears then in registry, and in view of the differences in diameters of the large throw-out gear 100, with respect to spur gear 94 driven thereby, and drive pinion 102, very rapid rotation of drive shaft 82, agitator shaft 44 and agitator 50 is caused for purposes of rotating the agitator in unidirectional manner.

As soon as the drive movement by the button 74 terminates by means of projection 70 reaching the end of the slot 72 and the button 74 is released, the spring 76 immediately moves the slide 54 in return direction toward starting position, and this instantly disengages throw-out gear 100 from contact with spur gear 94, whereupon the momentum of flywheel 96 insures continued unidirectional rotation of the drive member 92 for purposes of continuing the rotating movement of agitator 50. By continuous successive movements of the button 74 in driving direction, followed by instantaneous release thereof at the end of each movement thereof in said direction, continuous rotation of the agitator 50 results and no interference with the unidirectional rotation of the drive member 92 is caused at the end of each movement of the button 74 in driving direction.

From the foregoing, it will be seen that the toy washing machine described above is capable of furnishing considerable pleasure to children playing with the same, and also furnishing them with an understanding and appreciation of the operation of full-scale washing machines in a manner such as performed by the toy. All of the parts are capable of accurate production, especially if molded from plastic material, and assembly of the components is achieved quickly through the connection of a few simple screws, one exemplary illustration of which is shown in the upper part of FIG. 3, comprising axially aligned bosses and a screw 110 extending therethrough. Cement also may be employed to connect the abutting edges of the various vertical panels with the horizontal top and bottom panels 12 and 26, for example, thereby producing a sturdy top capable of durable existence. The capability of pivoting the cover 16 to open position to observe the operation of the agitator 50 also adds to the amusement afforded by the toy.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy washing machine comprising in combination, a generally rectangular box-like cabinet including a top having an opening therein for loading and unloading and a vertical front panel, a cover for said opening hinged at one end to said top, a cup-shaped tub supported by and extending downward from said top and contained within the upper portion of said cabinet, said tub being provided with a central sleeve integral with and extending upward from the bottom of said tub, an agitator member having an elongated thimble mounted upon and receiving said central sleeve of said tub and adapted for rotary movement therearound, a drive shaft extending upward through said sleeve of said tub and connected at the upper end thereof to the top of said thimble of said agitator for driving relationship therewith, a manually operable horizontally slidable actuating slide member within said cabinet in spaced relationship below the bottom of said tub and having a finger-engageable projection extending through a slot in said front panel, horizontal guide grooves formed respectively in a pair of horizontal mounting plates spaced vertically and fixedly supported in said cabinet below said tub, said grooves supporting opposite edges of said actuating slide member for reciprocatory movement in opposite driving and return directions, an elongated rack formed on one edge of said actuating slide member, a spur gear on the lower end of said drive shaft, a gear train mounted between said spur gear and the rack of said actuating slide member and operable when said actuating slide member is moved in driving direction to rotate said agitator in said tub, and power release means operable to disengage said actuating slide member and said spur gear on said drive shaft to permit movement of said actuating slide member in return direction without interfering with continual unidirectional rotation of said agitator.

2. The toy washing machine according to claim 1 in which said gear train also has one gear supported for throw-out movement when said actuating slide member is moved oppositely in return direction and thereby not interfere with unidirectional rotation of said agitator by said gear train, and spring means engageable with said actuating slide member and operable to move the same in return direction when said finger-engageable projection thereon is released.

3. The toy washing machine according to claim 2 in which said gear supported for throwout movement is mounted on a shaft extending between said mounting plates and the opposite ends of said shaft being mounted respectively in a pair of vertically aligned short slots formed by molding in said mounting plates and operable to permit movement of said throwout gear to and from engagement with the gear of said train normally engaged thereby when said drive shaft is being driven.

4. The toy washing machine according to claim 3 further including a flywheel coaxially connected to said drive shaft to aid in producing unidirectional rotation thereof and said agitator when said slide is moving in return direction.

5. The toy washing machine according to claim 1 further including supporting means for said mounting plates extending upwardly from the bottom of said cabinet to said mounting plates and supporting the same in vertically-spaced relationship as aforesaid.

6. The toy washing machine according to claim 5 in which said supporting means comprises an inverted box-like configuration fixed to and extending upwardly from the bottom of said cabinet and the upper panel thereof comprising the lower of said pair of horizontal mounting plates.

7. The toy washing machine according to claim 6 in which a plurality of posts are fixed respectively to the opposite ends of one of said mounting plates and extend to the other of said plates for connection thereto.

8. The toy washing machine according to claim 7 in which said posts are formed integrally with the lowermost mounting plate and extending upward to the upper mounting plate, and screws connecting said upper plate to the upper ends of said posts.

* * * * *